US010832514B2

(12) United States Patent
Korthouwer et al.

(10) Patent No.: US 10,832,514 B2
(45) Date of Patent: Nov. 10, 2020

(54) GAMING MACHINE INTEGRATION SYSTEM AND METHOD FOR OBTAINING DATA FOR THIRD PARTY SYSTEMS

(71) Applicants: Dennis Korthouwer, Amstelveen (NL); Anton Gerard Hofland, Brand-Laaben (AT)

(72) Inventors: Dennis Korthouwer, Amstelveen (NL); Anton Gerard Hofland, Brand-Laaben (AT)

( * ) Notice: Subject to any disclaimer, the term of this patent is extended or adjusted under 35 U.S.C. 154(b) by 0 days.

(21) Appl. No.: 16/572,504

(22) Filed: Sep. 16, 2019

(65) Prior Publication Data

US 2020/0294347 A1 Sep. 17, 2020

Related U.S. Application Data

(63) Continuation of application No. 16/354,153, filed on Mar. 14, 2019, now Pat. No. 10,417,858.

(51) Int. Cl.
*G07F 17/32* (2006.01)

(52) U.S. Cl.
CPC ..... *G07F 17/3209* (2013.01); *G07F 17/3206* (2013.01); *G07F 17/3258* (2013.01)

(58) Field of Classification Search
None
See application file for complete search history.

(56) References Cited

U.S. PATENT DOCUMENTS

2004/0106449 A1 6/2004 Walker
2005/0064940 A1* 3/2005 Petruccelli ..... A63F 13/79 463/43
2008/0164307 A1* 7/2008 Silverstein ..... G07F 17/16 235/380
2012/0242460 A1* 9/2012 Swiegers ..... G06K 19/06009 340/10.42
2017/0084106 A1* 3/2017 Borissov ..... G07F 17/3206

OTHER PUBLICATIONS

International Search Report and Written Opinion for PCT/IB2020/000144 dated Aug. 10, 2020; 12 pages.

* cited by examiner

*Primary Examiner* — Jason T Yen
(74) *Attorney, Agent, or Firm* — FisherBroyles, LLP; Rob L. Phillips

(57) ABSTRACT

System and method for capturing data from third-party systems in a non-intrusive way and using such data for starting a process and/or analytic purposes. The system and method work with external add-on or aftermarket products working in conjunction with electronic gaming machines in particular and third-party devices in general. For example, an add-on external jackpot system may be triggered each time an underlying electronic gaming machine is played. Accordingly, the system and method employ microdots, receivers, and computing devices configured and positioned to alert the add-on external jackpot system of each play of the underlying gaming machine. The system and method are non-intrusive.

22 Claims, 10 Drawing Sheets

100

110

GAMING MACHINE INTEGRATION SYSTEM AND METHOD FOR OBTAINING DATA FOR THIRD PARTY SYSTEMS

CROSS-REFERENCE

This application is a continuation of, and claims priority to, U.S. patent application Ser. No. 16/354,153 filed Mar. 14, 2019 which is incorporated herein by reference for all purposes.

FIELD OF THE INVENTION

The embodiments of the present invention relate to a system and method for capturing an input signal at a gaming machine, or other type of machine, through a non-intrusive and/or add-on mechanism.

BACKGROUND

Certain gaming machines may utilize add-on promotional and/or side bet jackpot systems. These systems are linked to the gaming machines post manufacturing of the same. As such, the systems require an input signal or trigger to activate. Fully integrating the systems into the already-manufactured gaming machine requires the cooperation of the gaming machine manufacturer, is labor intensive and cost prohibitive.

Thus, it would be advantageous to develop a non-intrusive and/or add-on mechanism capable of capturing an input signal at a gaming machine. The non-intrusive and/or add-on mechanism should be simple to install and operate.

SUMMARY

The embodiments of the present invention are configured to operate with various user interfaces, including push buttons, handles and touchscreens, associated with electronic gaming machines. No matter the user interface, the system and method detailed herein capture an input signal corresponding to a start of a game, height of a bet and/or related activity. This is important for aftermarket products working in conjunction with electronic gaming machines. For example, the embodiments of the present invention allow a system as described in U.S. Pat. No. 9,997,020 entitled "Local Jackpot System Appearing Global in Nature and Global Prize Management System and Method of Use" ("Global Patent") to be efficiently added to existing installed gaming machines with no intrusion of the gaming machine. U.S. Pat. No. 9,997,020 is incorporated herein by reference for any and all purposes.

For gaming machines using push buttons or handles (or other mechanical devices) a microdot chip (also referred to as a microdot herein) and receiver combination communicate with one another. Based on an applied force, the microdot communicates with the receiver to alert the third-party system that the activity (e.g., game start) has been triggered so that the third-party system may undertake its task.

For gaming machines having light emitting displays, a microdot grid is positioned on the display and is configured to communicate with a receiver to alert the third-party system that the activity (e.g., game start) has been triggered so that the third-party system may undertake its task.

Other variations, embodiments and features of the present invention will become evident from the following detailed description, drawings and claims.

DETAILED DESCRIPTION

Figure 1A:
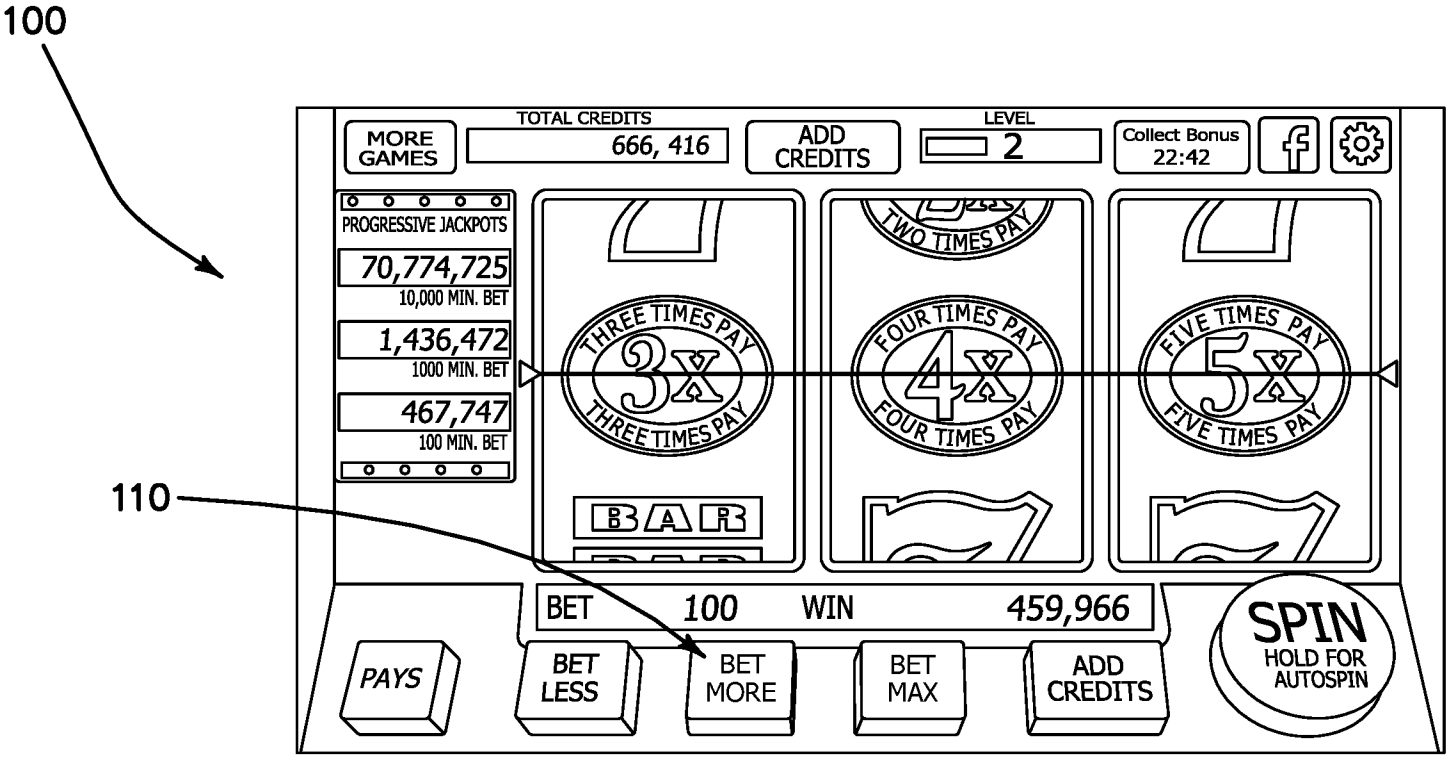
FIGS. 1A through 1C illustrate gaming machines of the type which may be utilized with the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Those skilled in the art will recognize that the embodiments of the present invention involve both hardware and software elements which portions are described below in such detail required to construct and operate a gaming machine method and system according to the embodiments of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object-oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagrams.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagrams. As used herein, a "gaming device" or "gaming machine" should be understood to be any one of a general purpose computer, as for example a personal computer or a laptop computer, a client computer configured for interaction with a server, a special purpose computer such as a server, or a smart phone, soft phone, tablet computer, personal digital assistant or any other machine adapted for executing programmable instructions in accordance with the description thereof set forth above.

While gaming machines are detailed below, those skilled in the art will recognize that other types of machines may benefit from the embodiments of the present invention. The system and method may also facilitate non-intrusive software testing, influence primary process, commence a secondary process and data analysis.

Figure 1B:
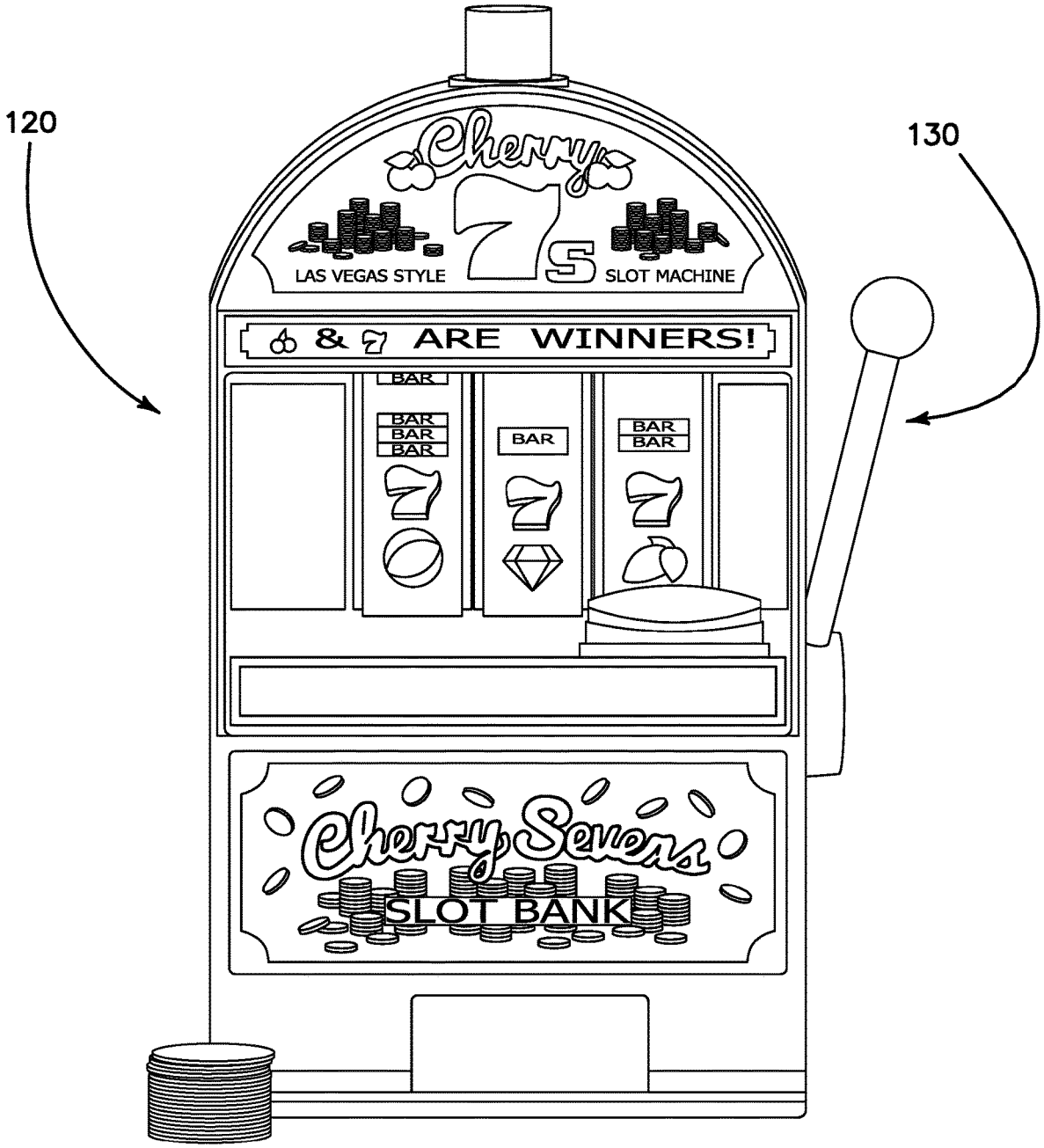
Figure 1C:
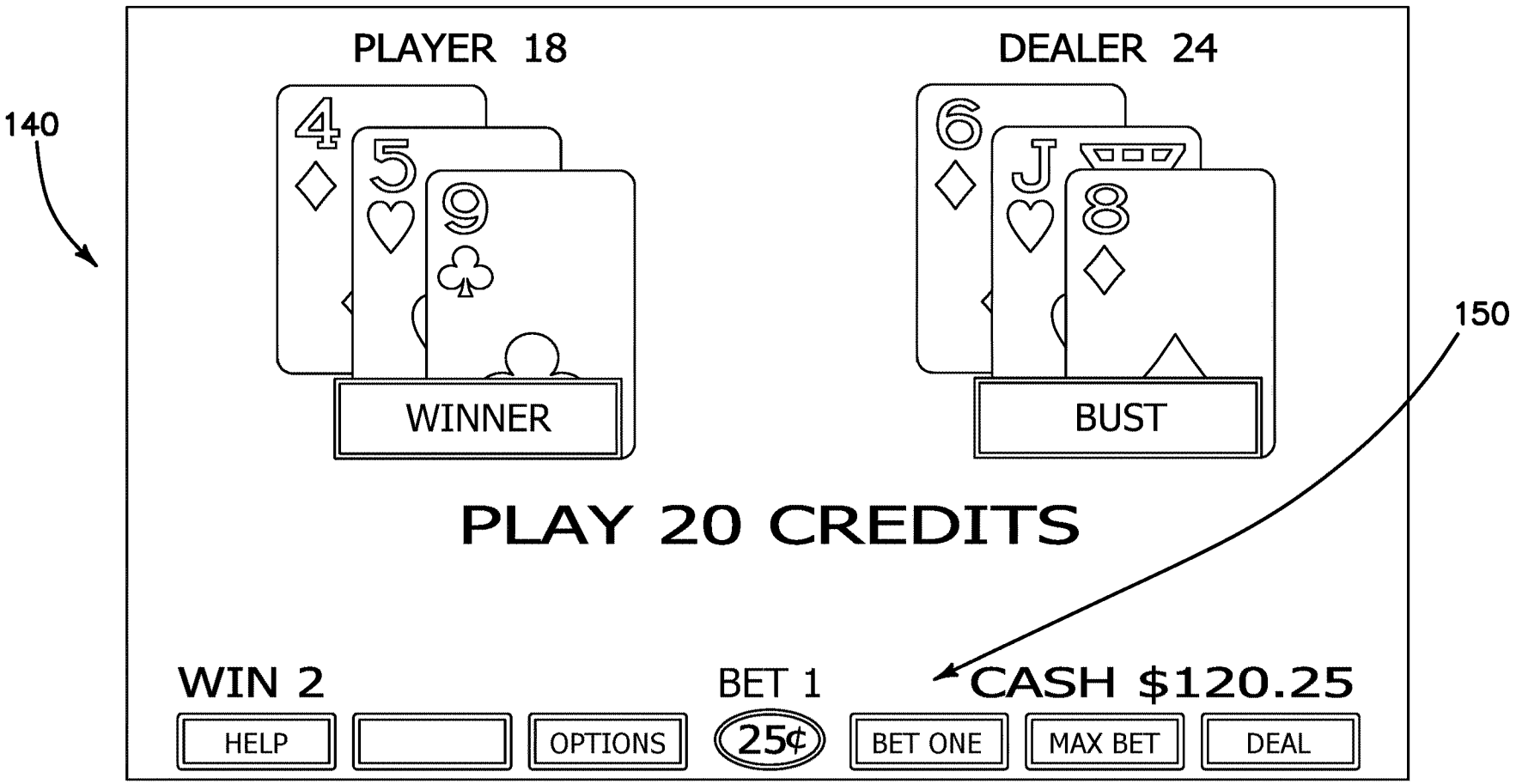

FIGS. 1A through 1C show various gaming machine types which may utilize the embodiments of the present invention. FIG. 1A shows a conventional slot machine 100 having a button panel 110 acting as a user interface; FIG. 1B shows a conventional slot machine 120 having a slot handle 130 acting as a user interface; and FIG. 1C shows a conventional video gaming machine 140 having a light emitting display 150 acting as a user interface. While gaming machines 100, 120 and 140 are shown, those skilled in the art will recognize that any type of electronic gaming machine may utilize the embodiments of the present invention.

Figure 2:
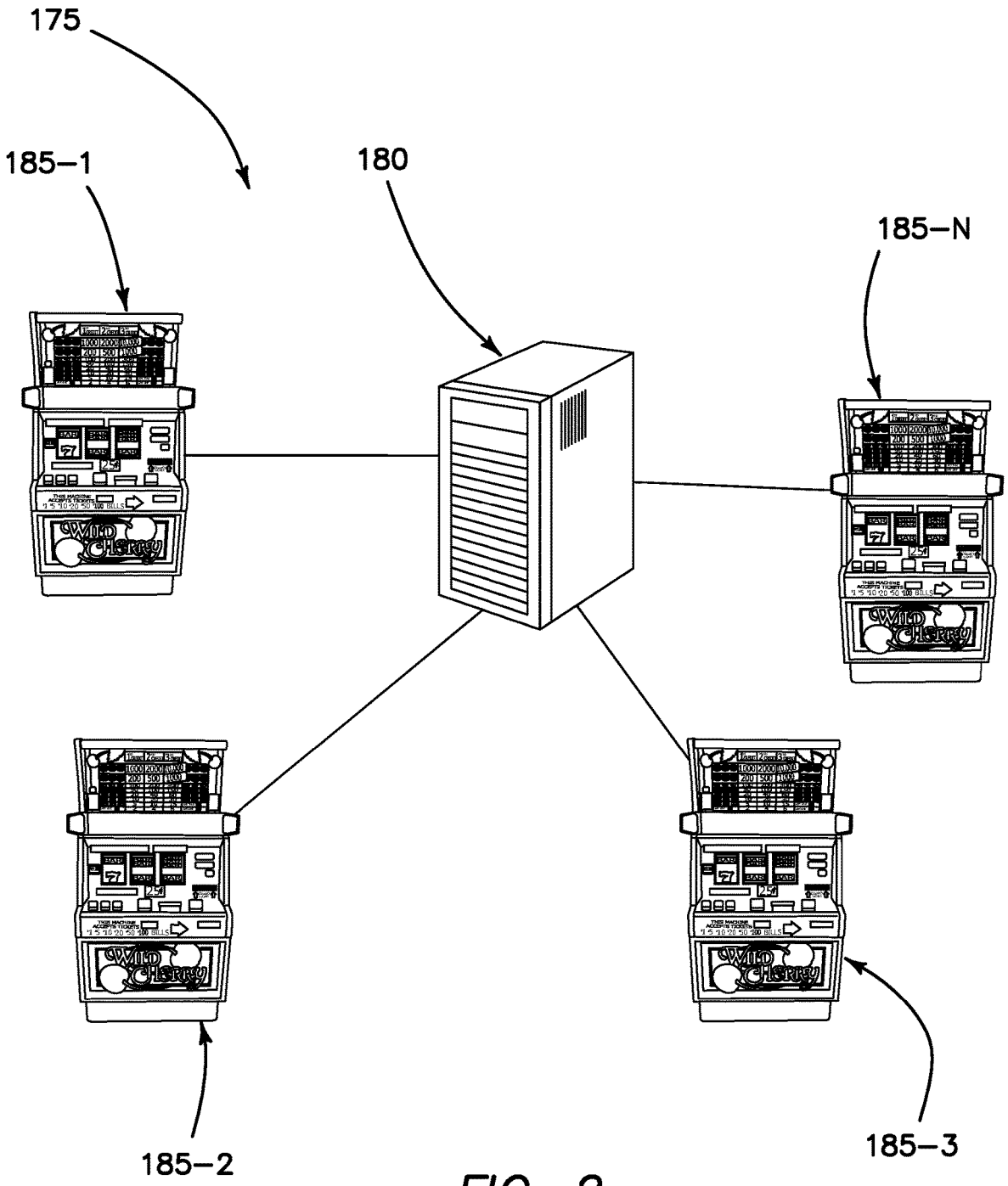
FIG. 2 illustrates a basic gaming machine network.

FIG. 2 shows a block diagram of a gaming network 175 which may utilize the embodiments of the present invention. The gaming network 175 comprises a central computer 180 (e.g., processor-equipped game server) in communication with multiple gaming machines 185-1 through 185-N.

The embodiments of the present invention shall be described relative to the jackpot system detailed in the Global Patent. Those skilled in the art will recognize that the embodiments of the present invention are suitable for any third-party or external systems needing to communicate with gaming machines.

Figure 3:
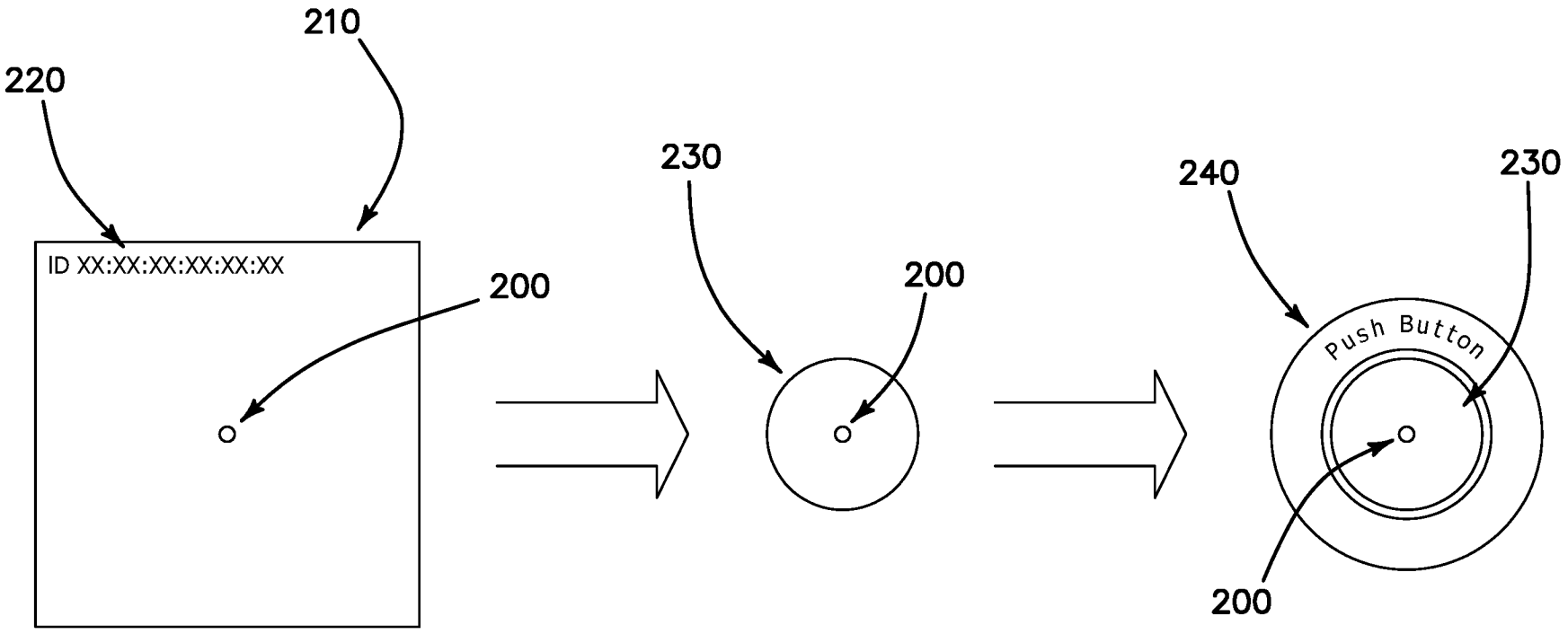
FIG. 3 illustrates a process for installing a microdot on a button interface of a gaming machine according to the embodiments of the present invention.

FIG. 3 shows a process for creating and installing a microdot on a button interface of a gaming machine according to the embodiments of the present invention. A microdot 200 is integrated onto a film 210. In one embodiment, the film 210 is a piece of thin, transparent film material with a sticky back allowing it to be applied to a push button or attached to a slot machine handle. The transparent film material may be cut to size to fit the application. The transparent film material has an energy harvesting capability used to power up the microdot 200 located at the center of the transparent film material as shown in FIG. 3. The microdot 200 has a unique identifier 220 displayed at the edge of the uncut film material 210.

Figure 4:
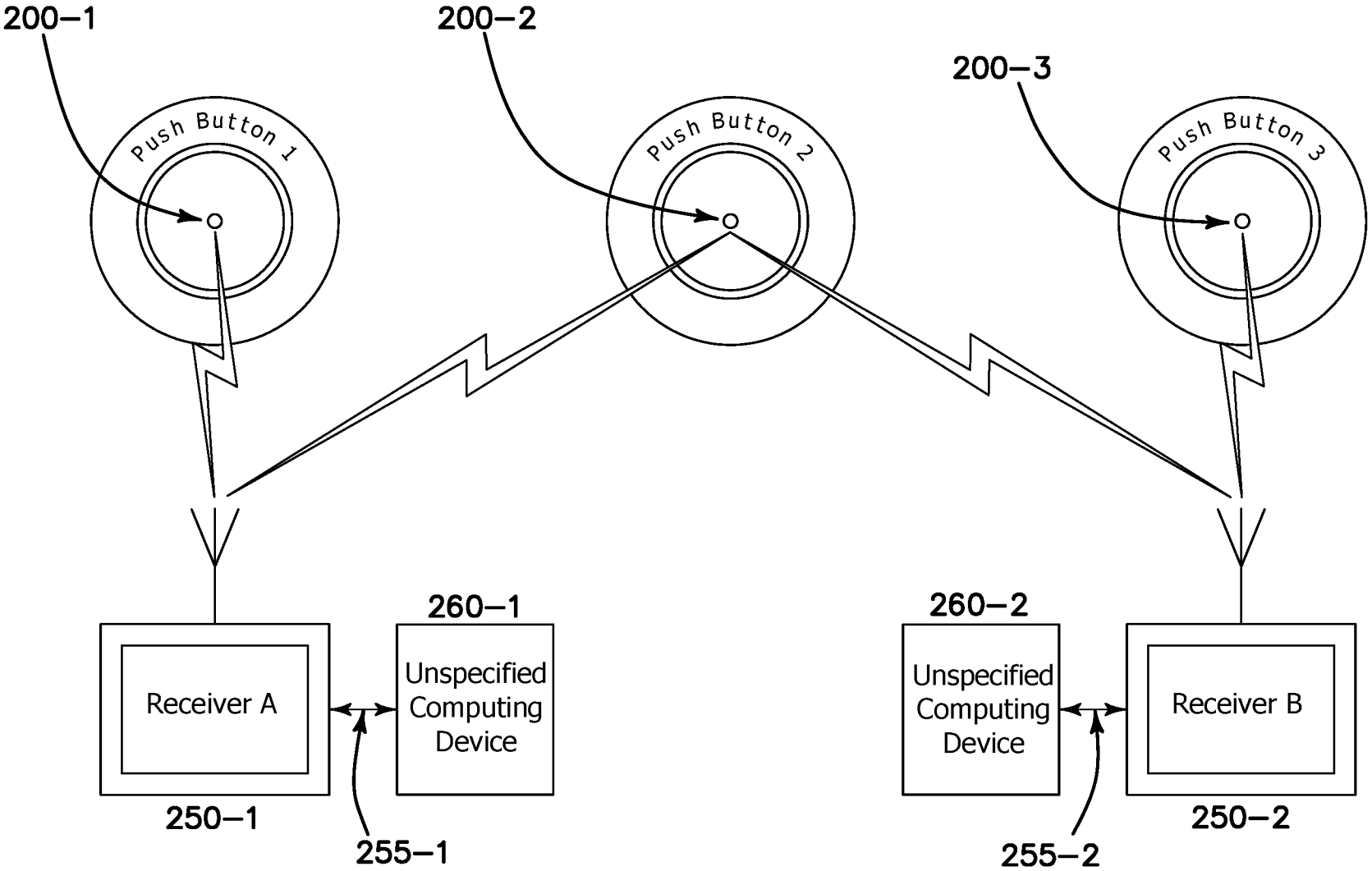
FIG. 4 illustrates a diagram showing microdots communicating with receivers according to the embodiments of the present invention.

As shown in FIG. 3, the thin, transparent film material 210 is cut into a shape 230 consistent with the subject gaming machine button 240. In this manner, the thin, transparent film 210 may be adhered to the gaming machine button 240. When powering up, the microdots 200-1 through 200-3 transmit their identifiers and a reading of the amount of energy harvested to paired receivers 250-1 through 250-2 as shown in FIG. 4. The amount of energy harvested is an indication of how strongly the button 240-1 through 240-3 has been pushed or with how much force the handle has been pulled. The receivers 250-1 and 250-2 are communicatively linked 255-1 and 255-2 to the jackpot system 260-1 and 260-2.

The receivers comprise one or more of the following properties. The receivers may pair with a microdot device while in a pairing mode. Once the receivers are in the pairing mode, the microdot device to be paired is then activated several times in succession, after which the receiver(s) is paired with the microdot device. Any transmissions it receives which do not originate from a paired device, are ignored. The receivers may also tune/calibrate the microdot device. The calibration allows for different sizes of transparent film devices, and thus different levels of energy harvesting due to the size variations and allows for reliably measuring the force with which a button has been pressed or by which a handle has been pulled. To calibrate an installed microdot device, it needs to be pressed with a known force or, in case of a handle, pulled with a known force. The amount of energy generated is then used to calculate an adjustment parameter within the receiver.

The receivers 250-1 through 250-2 which receive the readings from the one or more paired microdot devices. The receiver receives its power from the computing device. Through an interface, for instance, but not limited to, USB or SPI, the receiver communicates with the computing device and may, depending on the embodiment: (a) be put in pairing mode by the computing device; (b) transmit identifier and force level to the computing device every time it receives a reading from one of its paired microdot devices; and/or (c) be put in force calibration mode for a certain paired device, the identifier of which is provided by the computing device. Once in the force calibration mode, the operator shall apply a known force to the push button or handle of the gaming machine and the microdot device transmits its identifier and the generated power reading to the receiver. Upon receipt of this identifier and reading, the receiver determines a correction parameter and reports the known force value to the computing device which is saved for this specific device. The receivers may be further configured to (a) delete from its list of paired devices a specific device, the identifier of which is provided by the computing device; (b) add to its list of paired devices a specific device, the identifier of which is provided by the computing device, together with a correction parameter, also supplied by the computing device; and (c) produce a list of identifiers of paired devices and associated correction parameters.

Figure 5:
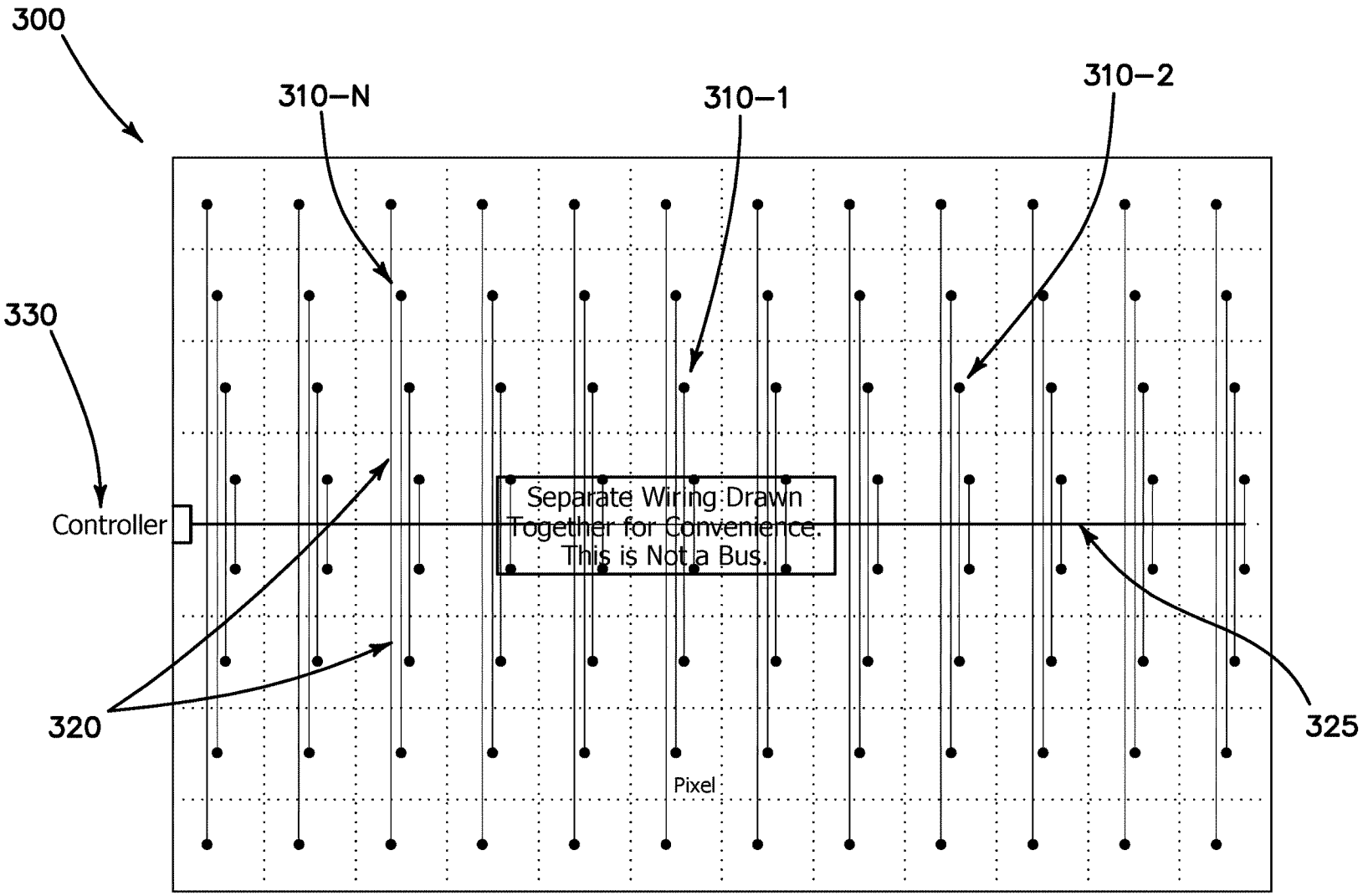
FIG. 5 illustrates a first exemplary wiring arrangement for a light emitting display with a microgrid film according to the embodiments of the present invention.

FIG. 5 refers to an embodiment of the present invention associated with gaming machines having light emitting displays (e.g., touchscreens). In such an embodiment, like the button and handle embodiments described above, the system and method are non-intrusive to the gaming machine. In this embodiment, a thin film 300 having a grid pattern of integral, light-sensitive microdots 310-1 through 310-N (i.e., microgrid film) is applied to the light emitting display. If the light emitting display incorporates touch screen technology, any touch sensitivity is retained by the microgrid film. In one embodiment, the grid pattern coincides with the resolution of the touchscreen onto which it is applied. The microdots 310-1 through 310-N are configured to sample or read the light output from the (touch)screen onto which the thin film 300 is applied. The microdots 310 only sample light levels underneath the thin film 300 whereby ambient light does not impact the readings. Based on the readings, a form of color coordinates may be created.

Figure 6:
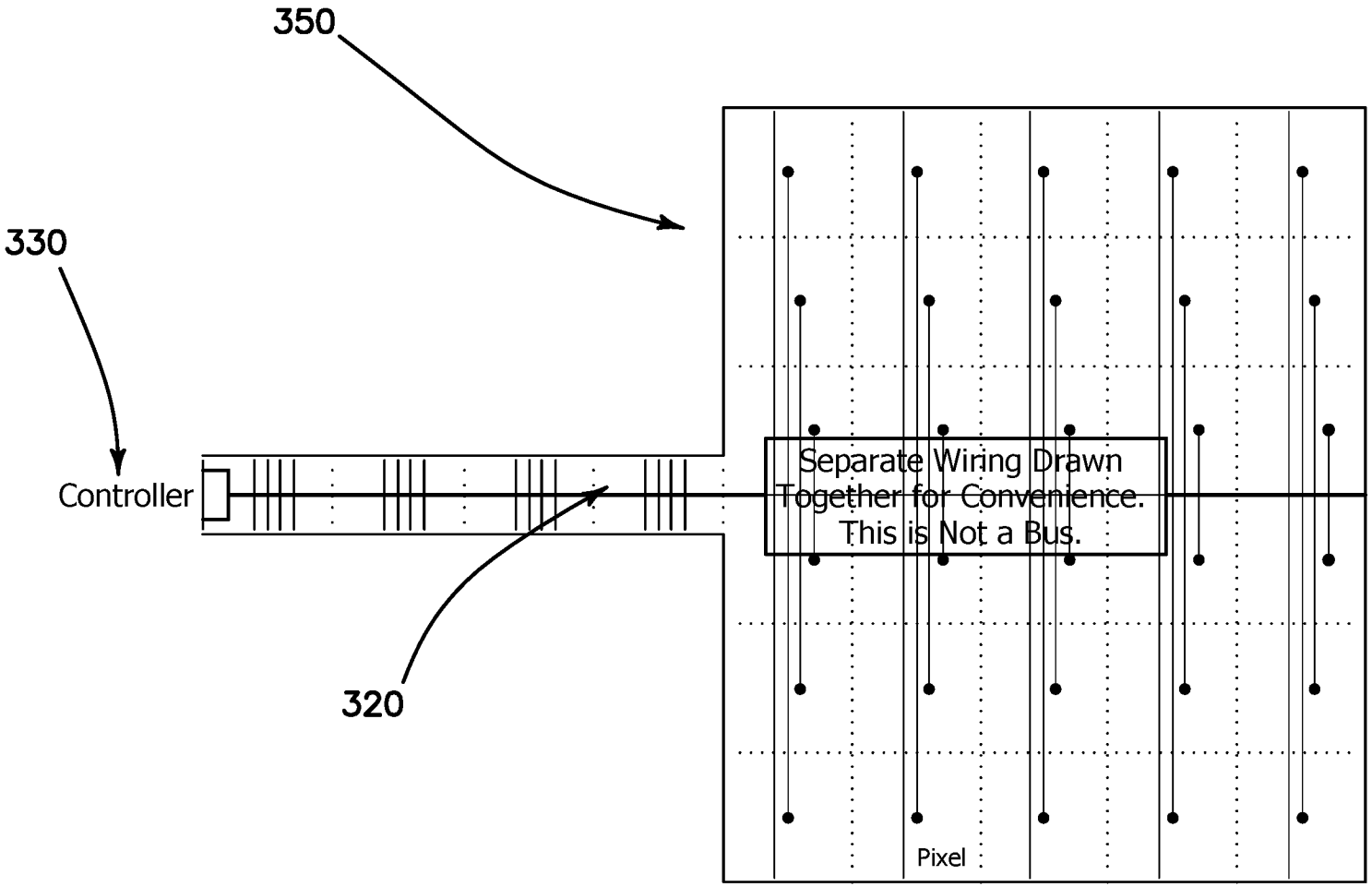
FIG. 6 illustrates a second exemplary wiring arrangement for a light emitting display with a microgrid film according to the embodiments of the present invention.

As shown in FIG. 5, the thin film 300 may be dimensioned to cover the entire (touch)screen to which it is applied. FIG. 6 shows an alternative thin film 350 dimensioned to cover only a portion of the (touch)screen to which it is applied but is otherwise operationally the same as thin film 300. In either embodiment, the microdots 310-1 through 310-N communicate via a wired arrangement 320 with a controller 330. The wiring arrangement 320 permits the controller 330 to determine the location of each microdot 310-1 through 310-N via its wire connection with the controller 330.

The use of the wired arrangement 320 permits the easy cutting of the thin film 300 to create the thin film 350 shown in FIG. 6. Since each microdot 310-1 through 310-N is wired to primary wire 325, the thin film 300 can be cut into any configuration as long as primary wire 325, leading to the controller 330, is not severed. While not shown, the controller 330 has an interface (e.g., USB) for communicating with the computing device. The computing device also supplies the controller 330 and microdots 310-1 through 310-N with power.

Figure 7:
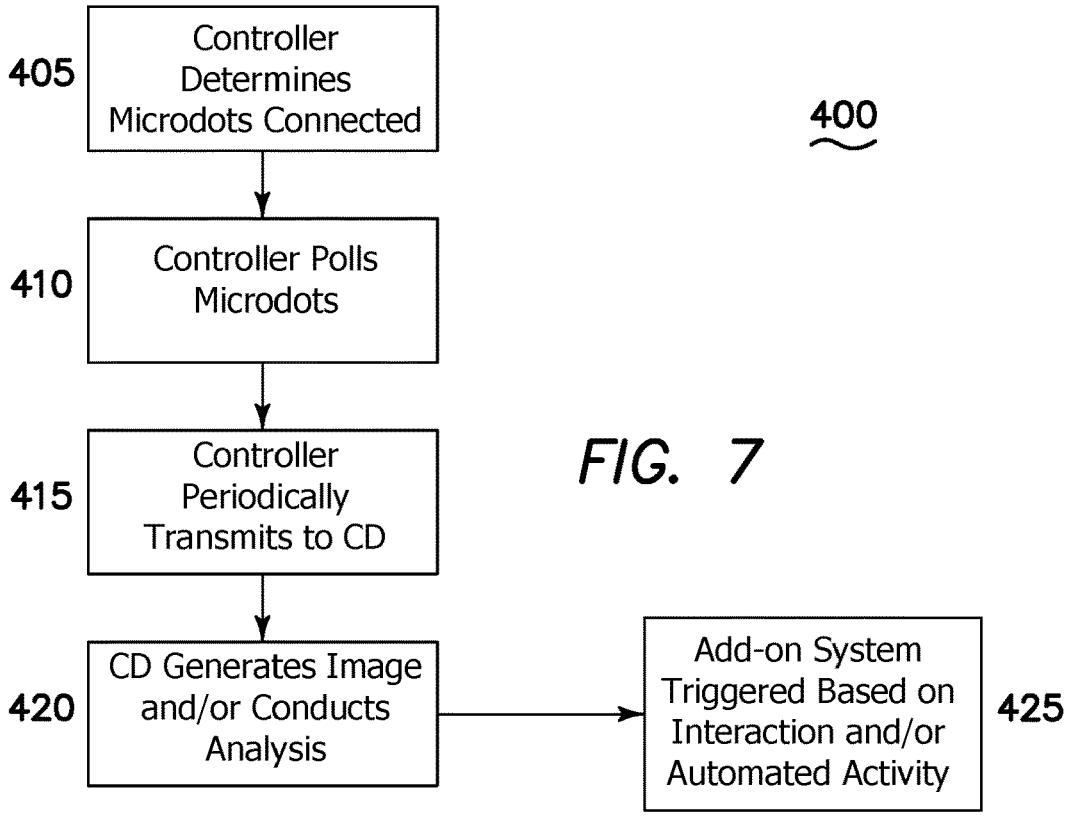
FIG. 7 illustrates a flow chart detailing operation of a light emitting display with a microgrid film embodiment according to the embodiments of the present invention.

Now referring to the flowchart 400 in FIG. 7, upon power up, at 405, the controller 330 first determines which microdots 310-1 through 310-N are connected. Based on cutting the thin film 300 for the subject light emitting display, many of the microdots 310-1 through 310-N may not exist on the thin, film 300 (i.e., were removed when thin film 300 cut). At 410, the controller polls the connected microdots 310-1 through 310-N. The polling period may be determined by the controller 330. At 415, the controller 330 periodically transmits to the computing device the location of each microdot 310-1 through 310-N and their readings. At 420, the computing device uses the received data to generate an image of the light emitting display or part thereof to which the thin film is attached or conducts analysis using the data. The period of transmissions may be determined by the controller 330. The captured data and/or image may be used for analysis purposes. At 425, responsive to the screen image changes captured, the add-on or external system may be triggered.

Figure 8:
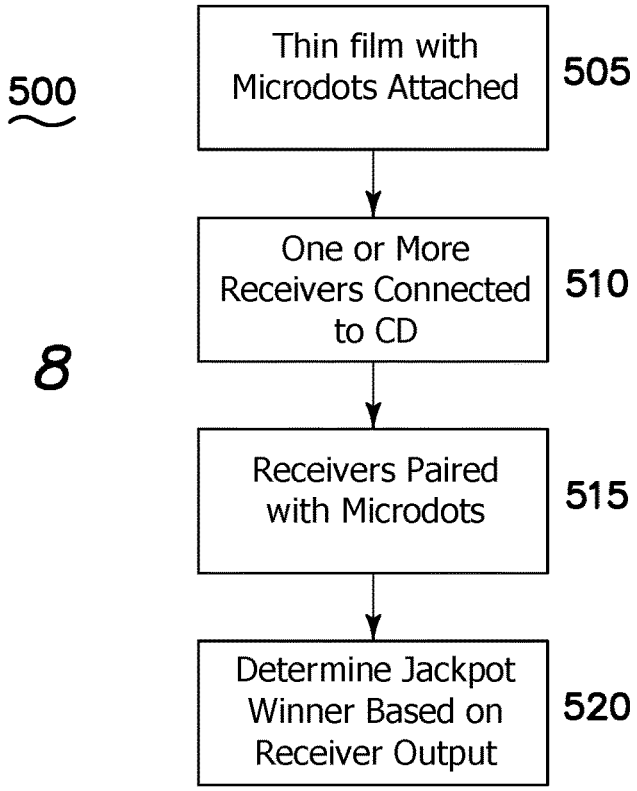
FIG. 8 illustrates a flow chart detailing installation of push button on a gaming machine according to the embodiments of the present invention.

FIG. 8 shows a flow chart 500 detailing a methodology for utilizing the embodiments of the present invention with the system described in the Global Patent. At 505, the subject gaming machines (e.g., slot machines) are subjected to the add-on process whereby the thin film with microdots is configured for attachment to an interface (e.g., push button, handle or touchscreen) of the gaming machine. Multiple interfaces (e.g., push button and handle) on a single gaming machine may receive the thin film and microdots. At 510, one or more receivers are connected to the computing device. At 515, the receivers are paired with the installed microdots. At 520, the computing device monitors receiver outputs and manages the jackpot software to determine if the player of the gaming machine is a jackpot winner. In this manner, the jackpot system can easily be linked to a plurality of the gaming machines without the need to open the gaming machines thereby eliminating any loss of certification and/or re-certification process for the gaming machine.

Figure 9:
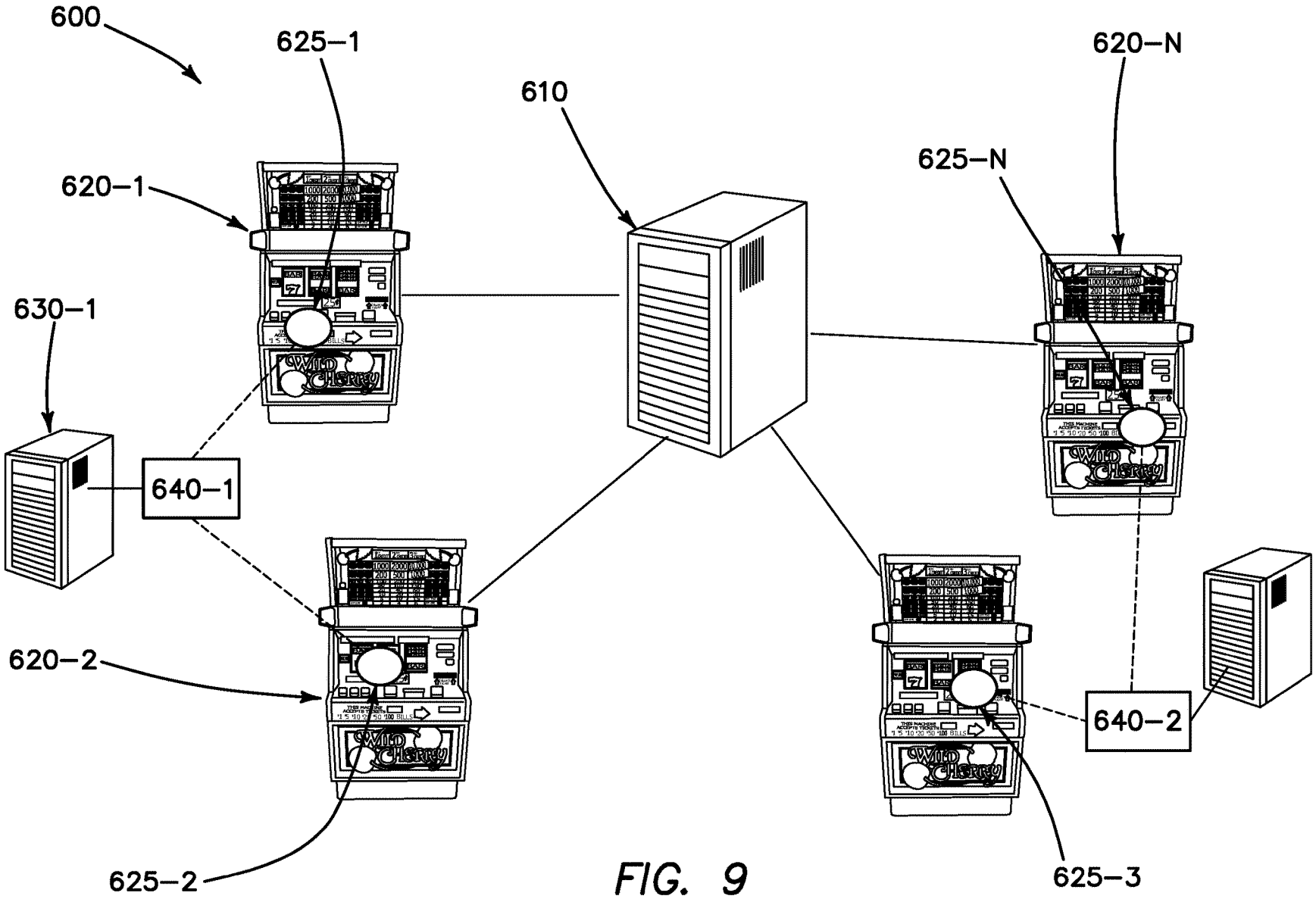
FIG. 9 illustrates a diagram of gaming machine network utilizing the jackpot system according to the embodiments of the present invention.

FIG. 9 shows a gaming machine network 600 utilizing the jackpot system based on the embodiments of the present invention. As shown, a central server or computer 610 provides game content, accounting functions, player tracking function, and the like for the network 600 of gaming machines 620-1 through 620-N. In this embodiment, a pair of computing devices 630-1 and 630-2 receivers and receivers 640-1 and 640-2 communicate with microdots 625 applied to each gaming machine 620-1 through 620-N.

While the detailed description herein focuses on electronic gaming machines, those skilled in the art will recognize that add-on or external systems may be triggered by any type of electronic device capable of being retrofitted as described herein.

Although the invention has been described in detail with reference to several embodiments, additional variations and modifications exist within the scope and spirit of the invention as described and defined in the following claims.

We claim:

1. A gaming system comprising:
- a plurality of gaming machines each having:
  - a monetary input device configured to receive a physical item associated with a monetary value;
  - a user interface configured to:
    - enable a player to select a wager for a game of chance and enable the player to initiate a cash out operation;
- at least one processor running executable instructions related to a game of chance, said at least one processor programmed to:
  - add said monetary value to a credit balance for said player; and
  - deduct said selected wager from said credit balance;
- one or more microdot chips adhered to said user interfaces of each of said plurality of gaming machines;
- one or more receivers paired with said one or more microdot chips, said receivers configured to detect signals from said one or more microdot chips indicative of pressure being applied to said one or more microdot chips or a pre-established light output of a light emitting or touch screen display being read; and
- one or more computing devices in communication with said receivers and configured to facilitate a secondary, external prize system associated with said plurality of gaming machines based on said detected signals from said one or more microdot chips.

2. The gaming system of claim 1 wherein said user interface of each of said plurality of gaming machines is: a touch screen display, light emitting display, button panel and/or slot machine handle.

3. The gaming system of claim 1 wherein said one or more microdot chips are integral with a thin, transparent film attachable to said plurality of gaming machines.

4. The gaming system of claim 3 wherein said thin, transparent film further includes multiple microdot chips connected to one another and a common controller.

5. The gaming system of claim 1 wherein said one or more microdot chips are configured to measure an amount of force applied to said user interface to which the microchip is applied.

6. The gaming system of claim 1 wherein said secondary, external prize system is a jackpot and/or promotional prize system.

7. A gaming system comprising:
- a plurality of gaming machines each having:
  - a monetary input device configured to receive a physical item associated with a monetary value;
  - a user interface configured to:
    - enable a player to select a wager for a game of chance and enable the player to initiate a cash out operation;
- at least one processor running executable instructions related to a game of chance, said at least one processor programmed to:
  - add said monetary value to a credit balance for said player; and
  - deduct said selected wager from said credit balance;
- a jackpot prize system comprising:
  - one or more microdot chips adhered to said user interfaces of each of said plurality of gaming machines, said one or more microdot chips configured to send a signal to one or more paired receivers indicating pressure has been applied to said one or more microdot chips or a pre-established light output of a light emitting or touch screen display has been read; and
  - one or more computing devices configured to facilitate a secondary, external prize system associated with said plurality of gaming machines based on said one or more receivers receiving said signals.

8. The gaming system of claim 7 wherein said user interface of each of said plurality of gaming machines is: a touch screen display, light emitting display, button panel and/or slot machine handle.

9. The gaming system of claim 7 wherein said one or more microdot chips are integral with a thin, transparent film attachable to said plurality of gaming machines.

10. The gaming system of claim 9 wherein said thin, transparent film further includes multiple microdot chips connected to one another and a common controller.

11. The gaming system of claim 7 wherein said secondary, external prize system is a jackpot and/or promotional prize system.

12. A gaming method comprising:
- linking a plurality of gaming machines each having:
  - a monetary input device configured to receive a physical item associated with a monetary value;
  - a user interface configured to:
    - enable a player to select a wager for a game of chance and enable the player to initiate a cash out operation;
- at least one processor running executable instructions related to a game of chance, said at least one processor programmed to:
  - add said monetary value to a credit balance for said player; and
  - deduct said selected wager from said credit balance;
- placing one or more microdot chips on said user interface of each of said plurality of gaming machines;
- configuring one or more receivers to pair with said one or more microdot chips such that said one or more receivers may receive signals indicative of activation of said one or more microdot chips; and utilizing one or more computing devices to facilitate a secondary, external prize system associated with said plurality of gaming machines based on said one or more receivers receiving said signals.

13. The gaming method of claim 12 wherein said user interface of each of said plurality of gaming machines is: a touch screen display, light emitting display, button panel and/or slot machine handle.

14. The gaming method of claim 12 wherein said one or more microdot chips are integral with a thin, transparent film attachable to said plurality of gaming machines.

15. The gaming method of claim 14 wherein said thin, transparent film further includes multiple microdot chips connected to one another and a common controller, said thin, transparent film configured to sample or read light output of a light emitting or touch screen display.

16. The gaming method of claim 12 wherein said one or more microdot chips are configured to detect a force applied to said user interface to which the microchip is applied.

17. The gaming system of claim 12 wherein said secondary, external prize system is a jackpot and/or promotional prize system.

18. A system comprising:

at least one electronic machine having a user interface, said at least one electronic machine configured for facilitating a first process;

one or more microdot chips adhered to said user interface;

one or more receivers paired with said one or more microdot chips, said receivers configured to detect signals from said one or more microdot chips indicative of pressure being applied to said one or more microdot chips or a pre-established light output of a light emitting or touch screen display has been read; and one or more computing devices in communication with said receivers and configured to facilitate a second process responsive to detection of said signals by said one or more receivers.

19. The system of claim 18 wherein said interfaces are push buttons, handles and/or light emitting display.

20. The system of claim 18 wherein said microdot chips are integral with a thin, transparent film attachable to said at least one electronic machine.

21. The system of claim 20 wherein said thin, transparent film further includes multiple microdot chips connected to one another and a common controller.

22. The system of claim 18 wherein said microdot chips are configured to detect a force applied to a user interface to which the microchip is applied.

* * * * *